US005782581A

United States Patent [19]

DeCanio

[11] Patent Number: 5,782,581

[45] Date of Patent: Jul. 21, 1998

[54] SCUBA TANK IDENTIFICATION COLLAR

[76] Inventor: Paul Joseph DeCanio, 35 Franklin Ave., Brentwood, N.Y. 11717

[21] Appl. No.: 692,039

[22] Filed: Aug. 2, 1996

[51] Int. Cl.[6] ..... B63C 11/02; G09F 3/16

[52] U.S. Cl. ..... 405/186; 40/666

[58] Field of Search ..... 405/186, 216; 40/666, 306, 316, 660

[56] References Cited

U.S. PATENT DOCUMENTS

| | | | |
|---|---|---|---|
| 3,787,993 | 1/1974 | Lyon | 40/306 |
| 3,977,104 | 8/1976 | Stuper | 40/316 X |
| 4,268,986 | 5/1981 | Piana | 40/316 |
| 5,275,282 | 1/1994 | Ross et al. | 40/666 X |
| 5,339,549 | 8/1994 | David et al. | 40/666 X |

FOREIGN PATENT DOCUMENTS

| | | | |
|---|---|---|---|
| 1 295 026 | 9/1959 | France | 40/316 |
| 2458855 | 2/1987 | France | 40/660 |

*Primary Examiner*—Tamara L. Graysay
*Assistant Examiner*—Frederick L. Lagman

[57] ABSTRACT

A device for allowing proper identification of a scuba tank in day or night diving conditions. The device includes a elastic body structure having a outer circumferential surface which extends from the first lip member to the second lip member which thereon has identification symbols and a inner circumferential surface which extends from the first lip member to the second lip member and which has inner ridges therein. The elastic body structure maybe made of a elastic phosphorescent material.

2 Claims, 1 Drawing Sheet

SCUBA TANK IDENTIFICATION COLLAR

BACKGROUND OF THE INVENTION

1. Field of the Invention

The invention relates generally to a device that allows identification of a scuba diver in day time or night time diving conditions.

2. Description of the Prior Art

Scuba tanks either commercial or sport have no identification on them which makes underwater communication difficult or in some cases impossible especially at night. This invention eliminates this problem.

SUMMARY OF THE INVENTION

The invention relates to a device that will allow proper identification of a scuba diver while underwater in daytime or nighttime diving conditions. It comprises a means for removably fastening the invention to the scuba tank. It is an object of this invention to provide an inexpensive device which will allow more efficient communication between divers, which for the commercial diver would increase worker productivity and to the sports diver would make a more safe and enjoyable dive.

DESCRIPTION OF THE PREFERRED EMBODIMENT

Figure 1:
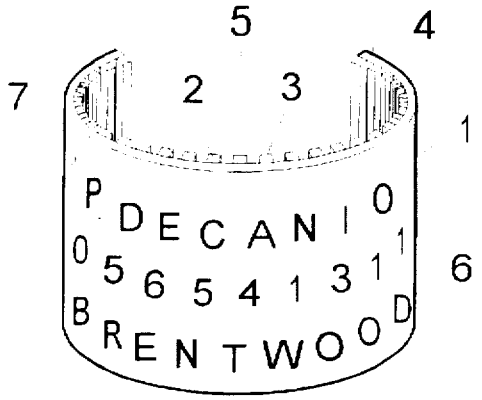
FIG. 1 is a elevation view showing an embodiment of the Scuba Tank Identification Collar.
Figure 2:
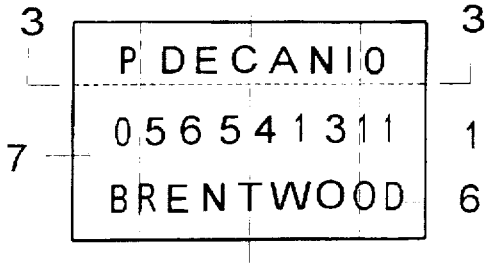
FIG. 2 is a front view showing another embodiment of the Scuba Tank Identification Collar.
Figure 3:
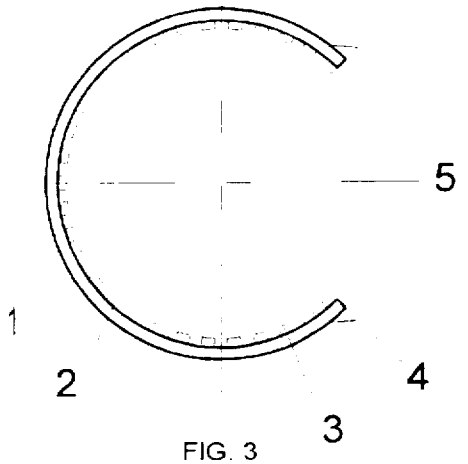
FIG. 3 is a sectional view, along section 3—3 of FIG. 2.
Figure 4:
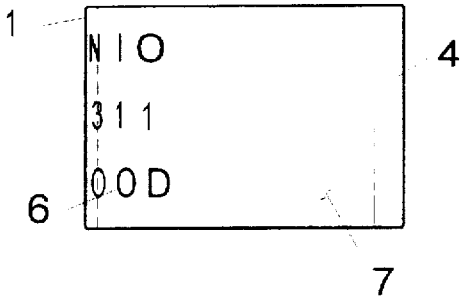
FIG. 4 is a side view showing yet another embodiment of the Scuba Tank Identification Collar.
Figure 5:
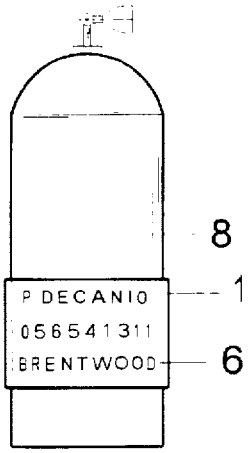
FIG. 5 is a front view showing an embodiment of the Scuba Tank Identification Collar installed on a scuba tank.
Figure 6:
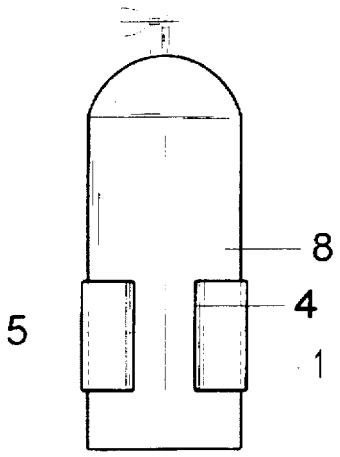
FIG. 6 is a back view showing yet another embodiment of the Scuba Tank Identification Collar installed on a scuba tank.

Referring to FIGS. 1,2,3,4,5 and 6 an embodiment of the invention is shown in which the Scuba Tank Identification Collar is removably installed to the scuba tank 8. The fastening means is shown in this embodiment as having the major elements of a elastic body structure 1, inner ridges 3 and lip members 4.

In this embodiment the elastic body structure 1 has a inner circumferential surface 2 which makes contact with the outer surface of the scuba tank 8. The inner circumferential surface 2 has inner ridges 3 which allow for water to drain out properly. The outer circumferential surface 7 which has Identification symbols 6 which are shown as alphabetical and numeral symbols. The elastic body structure 1 has an opening 5 which the inner circumferential surface 2 and the outer circumferential surface 7 meet which is angled outward and form lip members 4 which are perpendicular to the top and bottom surfaces of the elastic body structure 1.

The embodiment is removably fastened to the scuba tank 8 by applying pressure to the front of the elastic body structure 1 which cause the lip members 4 to make contact with the outer surface of the scuba tank 8, the elasticity of the elastic body structure 1 allows the scuba tank 8 through the back opening 5 which will snap the elastic body structure 1 inner circumferential surface 2 to encompass the scuba tank 8 with securing force.

The embodiment would be made of a elastic phosphorescent material and the identification symbols 6 would be installed to the outer circumferential surface 7 which would be visable to other divers.

The Scuba Tank Identification Collar would be manufactured and marketed in a separate package for easy installation to any scuba tank 8.

Although one detailed embodiment of the invention is illustrated in the drawings and previously described in detail this invention contemplates any configuration and design of components which will accomplish the equivalent result.

I claim:

1. A device for identification of a scuba tank in the day and night diving modes and from many visual dive positions which comprises:

an elastic body structure comprising an outer circumferential surface which extends from a first lip member to a second lip member, the outer circumferential surface includes identification symbols thereon an inner circumferential surface which extends from the first lip member to the second lip member, the inner circumferential surface include inner ridges therein which extend perpendicularly from a top edge and bottom edge of the elastic body structure, said lip members comprises a lip which angles out from each adjacent side of an opening of the said body structure, said lip members extend perpendicularly from the top edge and bottom edge of the said elastic body structure, means for the device to be attached to the scuba tank by engagement of said lip members to the outer surface of the scuba tank, pressure then is applied to the said elastic body structure, the elasticity of the said body structure allows the scuba tank through the adjacent said lip members which will snap said elastic body structure to encompass the scuba tank with securing force, the said inner ridges would allow for water to drain from between said inner circumferential surface and the scuba tank in the installed mode.

2. A device as recited in claim 1 wherein the said elastic body structure is made of a elastic phosphorescent material whereon said outer circumferential surface has identification symbols attached thereon, which allows for the identification of the scuba diver in the day and night diving modes at different diving positions.

* * * * *